US008162421B2

(12) United States Patent
Lim et al.

(10) Patent No.: US 8,162,421 B2
(45) Date of Patent: Apr. 24, 2012

(54) REFRIGERATOR

(75) Inventors: Jae Hoon Lim, Suwon-si (KR); Jae Myung Han, Gwangsan-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 829 days.

(21) Appl. No.: 12/010,882

(22) Filed: Jan. 30, 2008

(65) Prior Publication Data

US 2008/0203874 A1 Aug. 28, 2008

(30) Foreign Application Priority Data

Feb. 26, 2007 (KR) ..... 10-2007-0019201

(51) Int. Cl.
*A47B 96/04* (2006.01)

(52) U.S. Cl. ..... 312/401; 312/406

(58) Field of Classification Search ..... 312/401–408
See application file for complete search history.

(56) References Cited

U.S. PATENT DOCUMENTS

| | | | | |
|---|---|---|---|---|
| 3,005,227 | A * | 10/1961 | Horvay | 16/251 |
| 3,584,927 | A * | 6/1971 | Ott et al. | 250/458.1 |
| 4,602,826 | A * | 7/1986 | Zimmer | 312/7.2 |
| 6,193,340 | B1 * | 2/2001 | Schenker et al. | 312/265.5 |
| 6,430,946 | B2 * | 8/2002 | Roh et al. | 62/125 |
| 6,827,410 | B2 * | 12/2004 | Antos et al. | 312/405 |
| 6,945,621 | B2 * | 9/2005 | Shin | 312/405 |
| 7,097,213 | B2 * | 8/2006 | Antos et al. | 292/56 |
| 7,436,317 | B2 * | 10/2008 | Becke et al. | 340/815.48 |
| 2005/0045457 | A1 * | 3/2005 | Park | 200/61.7 |
| 2005/0138948 | A1 * | 6/2005 | Lee | 62/331 |
| 2006/0017360 | A1 * | 1/2006 | Lyvers et al. | 312/404 |
| 2008/0134698 | A1 * | 6/2008 | Cho et al. | 62/127 |
| 2008/0271475 | A1 * | 11/2008 | Wuesthoff et al. | 62/447 |
| 2008/0272679 | A1 * | 11/2008 | Wuesthoff et al. | 312/404 |
| 2009/0179539 | A1 * | 7/2009 | Henriksson et al. | 312/405 |

FOREIGN PATENT DOCUMENTS

KR 10-0674573 1/2007

* cited by examiner

*Primary Examiner* — Darnell Jayne
*Assistant Examiner* — Timothy M Ayres
(74) *Attorney, Agent, or Firm* — Staas & Halsey LLP

(57) ABSTRACT

A refrigerator includes a body having a storage compartment, and a pair of pivotally rotatable doors provided at opposite sides of the body to open or close the storage compartment. Provided on an upper surface of the body are hinge covers to cover upper hinges of the respective doors and a top cover to prevent the swollen upper surface of the body from being exposed from the front side of the body. The hinge cover and the top cover are integrally formed with each other. In the refrigerator, a display to show the temperature of a storage compartment, the strength of cool air, and a door switch to detect whether the door is opened away from or closed towards the body are provided at a front plate of the top panel.

7 Claims, 5 Drawing Sheets

REFRIGERATOR

CROSS-REFERENCE TO RELATED APPLICATIONS

This application claims the benefit of Korean Patent Application No. 10-2007-0019201, filed on Feb. 26, 2007 in the Korean Intellectual Property Office, the disclosure of which is incorporated herein by reference.

BACKGROUND

1. Field

The present invention relates to a refrigerator, and, more particularly, to a hinge cover and a top cover for a refrigerator.

2. Description of the Related Art

In general, a refrigerator is an apparatus to supply cool air, which is generated from an evaporator of a refrigeration cycle, into a storage compartment, for keeping various food reserves inside the storage compartment in a fresh state for a long time. The refrigerator includes a body forming the outer appearance of the refrigerator, a storage compartment defined in the body to have an opened front side, and a door coupled to a front side of the body to open or close the storage compartment.

Conventionally, domestic refrigerators may be classified, on the basis of the arrangement of a refrigerating compartment and a freezing compartment and the installation structure of doors, into a general type refrigerator, a side-by-side type refrigerator, a mixed type refrigerator, etc. In the most widely used general type refrigerator, a freezing compartment and a refrigerating compartment are arranged above and below each other, and also, a freezing compartment door and a refrigerating compartment door are arranged above and below each other. In the side-by-side type refrigerator, a freezing compartment and a refrigerating compartment are arranged side by side, and a freezing compartment door and a refrigerating compartment door are arranged side by side. In the mixed type refrigerator, a freezing compartment is beneath and a refrigerating compartment is on top. The freezing compartment is opened or closed by a drawer type door, and the refrigerating compartment is opened or closed by a pair of refrigerating compartment doors.

One example of the mixed type refrigerator is disclosed in Korean Patent Laid-open Publication No. 2005-0117536. The conventional mixed type refrigerator, disclosed in the above publication, is configured such that a refrigerating compartment is provided in an upper section of a refrigerator body and a freezing compartment is provided in a lower section of the body. The refrigerating compartment is opened or closed by a pair of refrigerating compartment doors, and the freezing compartment is opened or closed by a drawer type door.

In all the above-described conventional refrigerators, to prevent a hinge shaft of each door, which is opened away from or closed to a refrigerator body via a pivotal rotation thereof, from being exposed to the outside for improving the outer appearance of the refrigerator, a hinge cover is provided on the top of the body. Also, a top cover is provided on an upper surface of the body, to hide swelling that is caused as a heat-insulating material is expanded unevenly in the course of being foamed into the body.

However, since only one of the covers may be installed or the respective covers are installed separately, the above-described conventional refrigerators have the problem of high manufacturing costs due to an increased number of elements.

Further, since the hinge cover and the top cover are separated from each other, there is the problem of deterioration of the outer appearance.

SUMMARY

Accordingly, it is an aspect of the present invention to provide a refrigerator having a top panel in which the configuration of a hinge cover and a top cover is improved to achieve reduced manufacturing costs and improved outer appearance.

Additional aspects and/or advantages of the invention will be set forth in part in the description which follows and, in part, will be apparent from the description, or may be learned by practice of the invention.

The forgoing and/or other aspects of the present invention can be achieved by providing a refrigerator including a body defining a storage compartment; at least one door rotatable to open or close the storage compartment and comprising a hinge; and a top panel provided on an upper surface of the body and including a hinge cover to cover the hinge of the door, and a top cover to cover a front side of the upper surface of the body, the hinge cover and the top cover being integrally formed.

The at least one door may include a pair of doors installed at opposite sides of the body, respectively.

The top panel may include a front plate, both side plates, and a rear plate to have a predetermined inner space, an end of each plate coming into contact with and being supported by the body.

Each of the front plate and the side plates may include a stepped portion formed at the end thereof to rest on an associated corner of the body.

The rear plate may include a center portion and both end portions, the center portion having a height different from a height of both the end portions.

The front plate may include at least one of a display and a door switch.

The forgoing and/or other aspects of the present invention can be achieved by providing of a refrigerator including: a body having a storage compartment; and a pair of pivotally rotatable doors provided at opposite sides of the body, respectively, to open or close the storage compartment, further comprising: a top panel provided on an upper surface of the body and including hinge covers to cover upper hinges of the respective doors, respectively, and a top cover to cover a front side of the upper surface of the body, the hinge covers and the top cover being integrally formed with each other.

The top panel may include a front plate, both side plates, and a rear plate to have a predetermined inner space, an end of each plate coming into contact with and being supported by the body.

Each of the front plate and the side plates may include a stepped portion formed at the end thereof to rest on an associated corner of the body, and the rear plate may include a center portion and both end portions, the center portion having a height different from a height of both the end portions.

The front plate may include at least one of a display and a door switch.

BRIEF DESCRIPTION OF THE DRAWINGS

These and/or other aspects and advantages will become apparent and more readily appreciated from the following description of the embodiments, taken in conjunction with the accompanying drawings, of which.

DETAILED DESCRIPTION OF THE EMBODIMENTS

Figure 1:
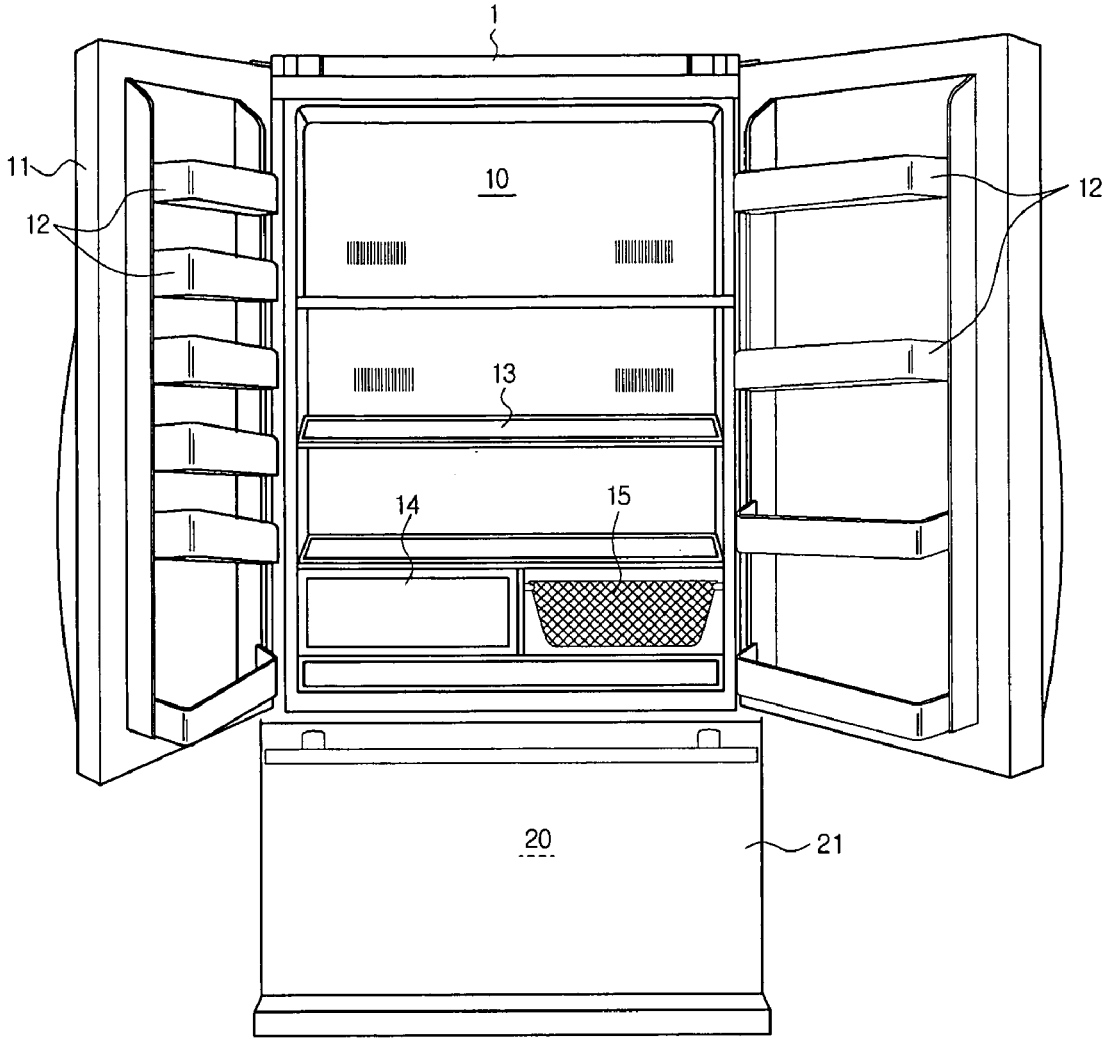
FIG. 1 is a view showing a refrigerator according to an embodiment the present invention.

Reference will now be made in detail to the embodiments, examples of which are illustrated in the accompanying drawings, wherein like reference numerals refer to the like elements throughout. The embodiments are described below to explain the present invention by referring to the figures.

FIG. 1 is a view showing a refrigerator according to an embodiment of the present invention. Referring to the drawing, the refrigerator includes a body 1 having a storage compartment therein. The storage compartment is divided into an upper storage compartment 10 serving as a refrigerating compartment and a lower storage compartment 20 serving as a freezing compartment.

Doors 11 and 12 are installed at front sides of the respective storage compartments 10 and 20, to selectively open or close the interior of the respective storage compartments 10 and 20. Specifically, the refrigerating compartment 10 is provided with a pair of doors 11 at left and right sides thereof, respectively. The doors 11 are opened away from or closed to the body 1 via a pivotal rotation thereof. The freezing compartment 20 is provided with a door 21. The door 21 is opened away from or closed towards the body 1 via a forward sliding movement thereof. The door 21 of the freezing compartment 20 is a drawer type door, and slides together with an inner receiving member (not shown) upon an opening or closing operation thereof.

Each of the pivotally rotatable opening/closing doors 11 includes a plurality of shelves 12 installed at a rear surface thereof in multiple stages, to facilitate easy organization of food reserves. Similarly, a plurality of shelves 13 and drawers 14 or basket-shaped receiving members 15 are installed in the refrigerating compartment 10.

Although not shown, the body 1 is installed, at the rear side of the refrigerating compartment 10, with an evaporator, which operates a refrigeration cycle to generate cool air, for the supply of cool air into the storage compartment 10. Also, a machine room is provided at the rear side of the freezing compartment 20 of the body 1, to receive a compressor and a condenser compressing a refrigerant and condensing the compressed refrigerant.

Figure 2:
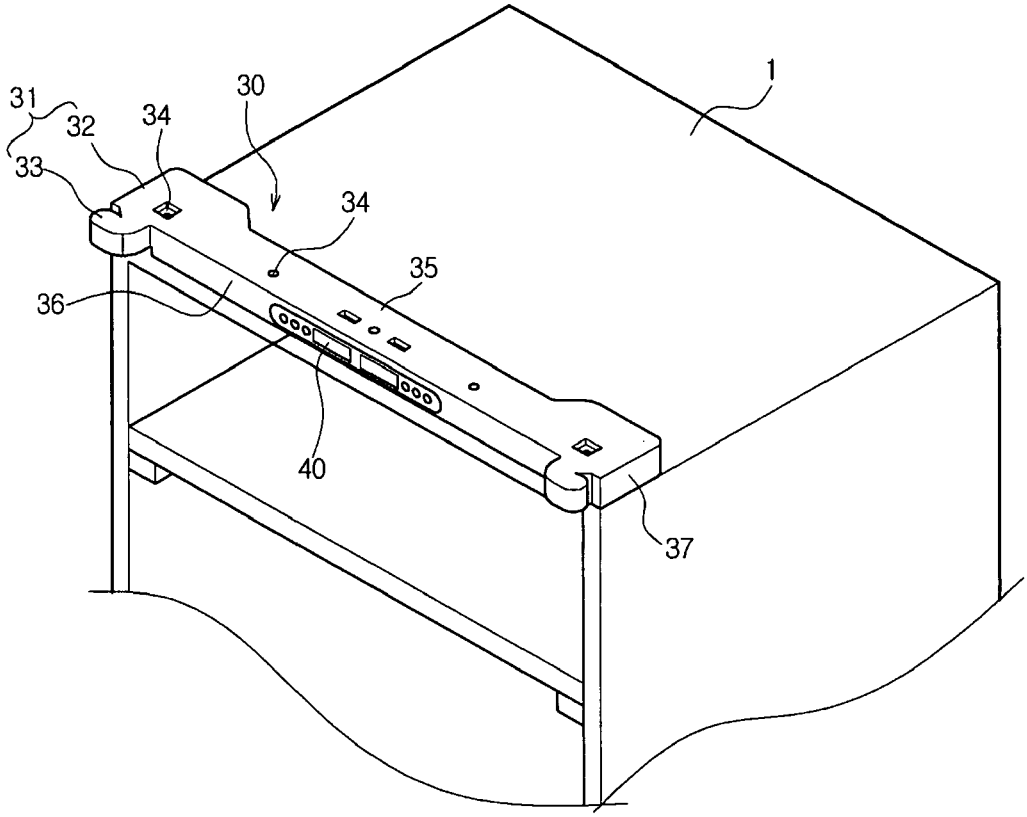
FIG. 2 is a perspective view showing a top panel provided in the refrigerator according to the embodiment of the present invention of FIG. 1.
Figure 3:
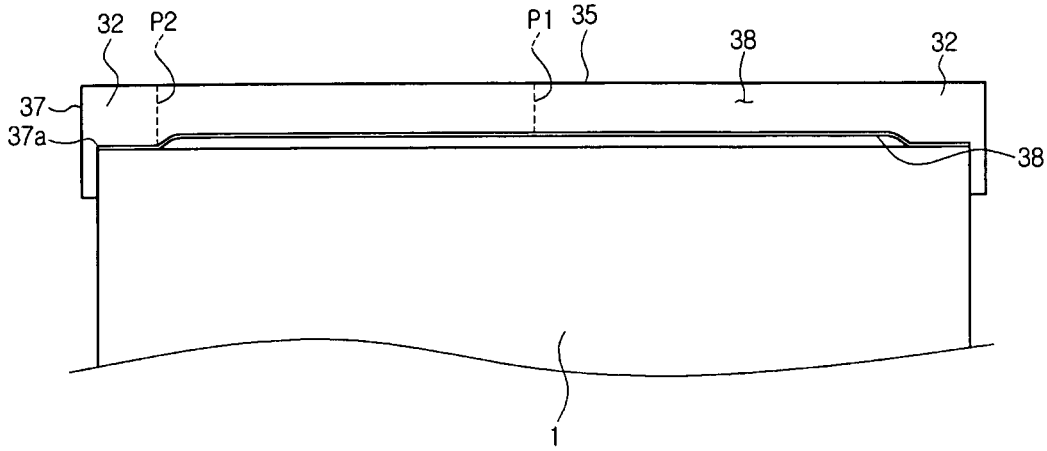
FIG. 3 is a rear view of FIG. 2.
Figure 4:
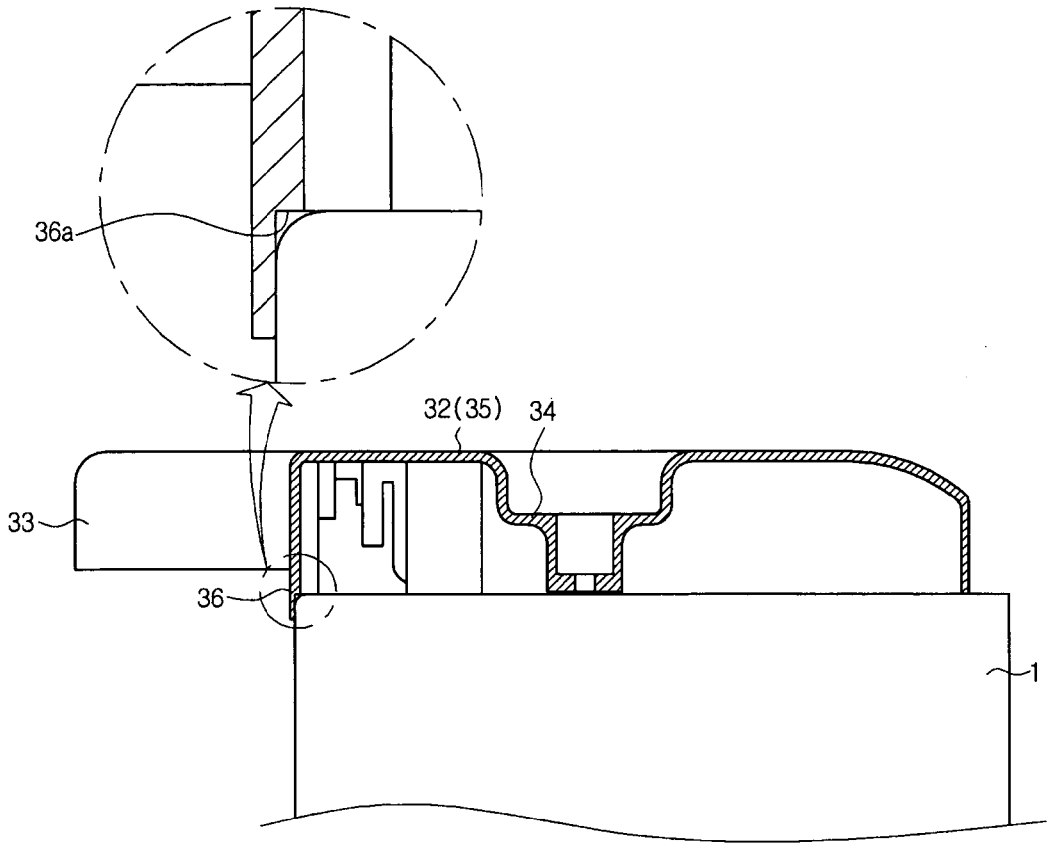
FIG. 4 is a side sectional view of FIG. 2.
Figure 5:
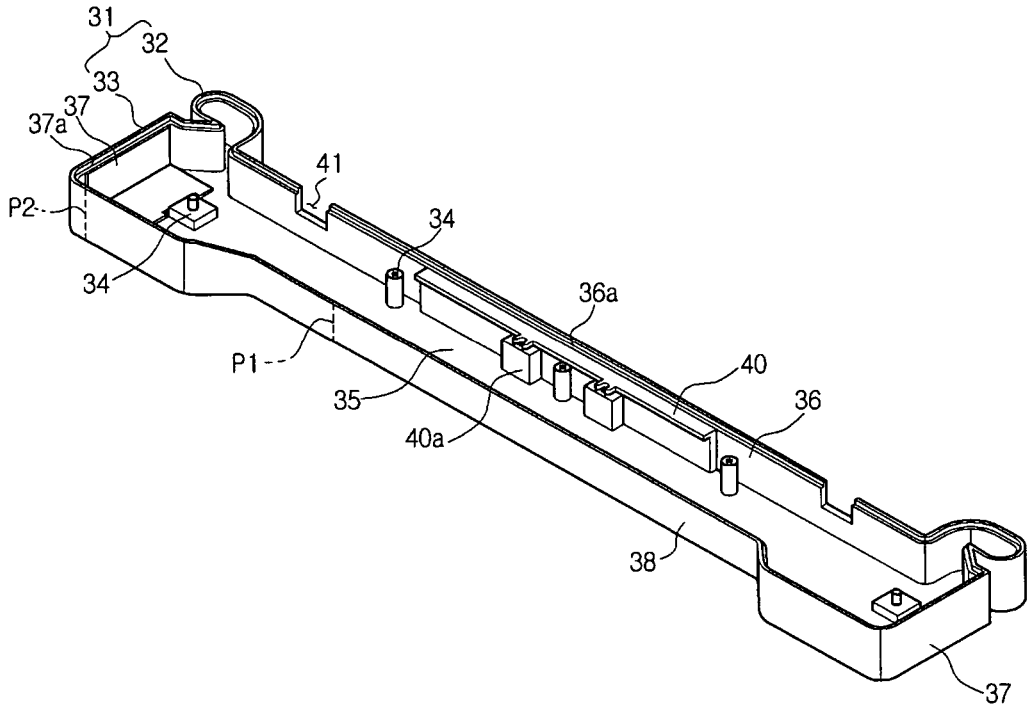
FIG. 5 is a bottom view showing the top panel of the refrigerator according another embodiment of to the present invention.

FIG. 2 is a perspective view showing a top panel provided in the refrigerator according to the embodiments of the present invention. FIGS. 3 and 4 are a front sectional view and a side sectional view of FIG. 2, respectively, and FIG. 5 is a bottom view of FIG. 2.

Referring to the drawings, the top panel 30 of the embodiments of the present invention includes a pair of hinge covers 31 provided on an upper surface of the refrigerator to cover upper hinge assemblies of both the doors 11, and a top cover 35 to cover a front side of the upper surface of the body 1. The top panel 30 is formed by, for example, an injection molding such that the hinge covers 31 and the top cover 35 are integrally formed with each other. The top panel 30 has a predetermined height to have an inner space.

Each of the hinge covers 31 includes a hinge body portion 32 disposed on the upper surface of the body 1 to cover a base bracket (not shown) of the associated hinge assembly, and a hinge shaft portion 33 protruding forward from the hinge body portion 32 to cover a hinge shaft (not shown) of the hinge assembly provided at the door, the hinge shaft being fitted into the base bracket. The hinge body portion 32 has a screw fastening recess 34 formed in an upper surface thereof to screw the top panel 30 to the body 1.

The top cover 35 is interposed between both hinge covers 31, between both the hinge body portions 32, to connect these elements to each other. Similar to the above described hinge body portion 32, the top cover 35 has a plurality of screw fastening recesses 34 formed in an upper surface thereof. In consideration of the fact that a front surface of the top cover 35 is exposed only when the door 11 is opened away from the body 1, the top cover 35 may be provided with other elements, for example, a display 40 to show the temperature of a storage compartment, the strength of cool air, etc., and a door switch 41 to detect whether the door is opened away from or closed towards the body 1.

The top panel 30 includes a front plate 36 of the top cover 35, opposite side plates 37 of the hinge covers 31, and a rear plate 38 of the top cover 35 and the hinge covers 31. Lower ends of the respective plates 36, 37, and 38 come into contact with and are supported by the upper surface of the body 1 such that a predetermined space is defined between the upper surface of the body 1 and the top panel 30. The predetermined space is to prevent the top panel 30 from coming off the body 1 even if the upper surface of the body 1 is swollen due to an uneven expansion of a heat-insulating material (for example, urethane) to be foamed between an inner shell and an outer shell of the refrigerator body 1 in the manufacture of the body 1.

Considering the above-described configuration with reference to FIGS. 3 and 4 in more detail, each of the front plate 36 and the side plates 37 has a stepped portion 36*a* or 37*a* formed at the lower end thereof. Also, the rear plate 38 is configured such that a central portion thereof has a height P1 different from a height P2 of an end portion. Accordingly, when the top panel 30 is disposed on the body 1, the stepped portions 36*a* and 37*a* rest on front corners of the body 1 and the rear plate 38 comes into contact with the swollen upper surface of the body 1. Therefore, there is no risk that the top panel 30 comes off the body 1. Although the above description exemplifies that the center of the upper surface is swollen (in a longitudinal direction of the top panel 30), the present invention is not limited thereto.

Alternatively, as shown in FIG. 5, the top panel 30 according to another embodiment of the present invention may be configured, on the basis of the fact that the top panel 30 has a predetermined inner space, that the display 40 to show the state of the storage compartment is provided inside the top panel 30, or the door switch 41 to detect whether the door 11 is opened away from or closed towards the body 1 is provided inside the top panel 30 and marked on the front plate 36. This alternative configuration has the effect of further improving the outer appearance of the refrigerator. In FIG. 5, reference numeral 40*a* represents a block to keep a substrate of the display 40 at a fixed position.

As apparent from the above description, the embodiments of the present invention provides a top panel for a refrigerator, in which a hinge cover to cover a hinge assembly and a top cover to prevent the swollen upper surface of a refrigerator body from being exposed from the front side of the body are integrally formed with each other, resulting in a reduction in manufacturing costs and achieving an easy assembling operation.

Further, in the refrigerator according to the embodiments of the present invention, the top panel can be provided, at a front plate thereof, with a display to show the temperature of a storage compartment, the strength of cool air, etc. and a door switch to detect whether the door is opened away from or closed towards the body. This has the effect of further improving the outer appearance of the refrigerator.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body defining a storage compartment;

at least one door rotatable to open or close the storage compartment and comprising a hinge; and a top panel provided with an upper surface of the body and including a hinge cover to cover the hinge of the door, and a top cover to cover an upper portion of a front end of the upper surface of the body, the hinge cover and the top cover being integrally formed with each other, the top panel being provided with a front plate, a plurality of side plates and a rear plate, wherein the rear plate of the top panel includes end portions, which extend from the respective side plates and each of which has a lower end supported on the upper surface of the body, and a center portion which extends between the end portions, and wherein a height of the center portion of the rear plate is less than a height of the end portions of the rear plate such that a lower end of the center portion of the rear plate is spaced apart from the upper surface of the body, whereby when a bulging phenomenon occurs at the upper surface of the body, the center portion of the rear plate accommodates a part of the bulged upper surface of the body.

2. The refrigerator according to claim 1, further comprising a stepped portion provided at inner surfaces of the front plate and the side plates of the top panel such that the stepped portion is supported on a front end of an upper surface of the body and both side ends of the body.

3. A refrigerator comprising:

a body defining a storage compartment;

a door rotatable to open or close the storage compartment; and a top panel coupled with an upper surface of the body and comprising a top cover at a top of the panel, a front plate at a front of the panel, side plates at respective sides of the panel and a rear plate at a rear of the panel, the front plate and the side plates each comprising a stepped portion formed at a respective end thereof to cover corresponding surfaces adjacent to a corner of the body, wherein the rear plate of the top panel includes end portions, which extend from the respective side plates and each of which has a lower end supported on the upper surface of the body, and a center portion which extends between the end portions, and wherein a height of the center portion of the rear plate is less than a height of the end portions of the rear plate such that a lower end of the center portion of the rear plate is spaced apart from the upper surface of the body, whereby when a bulging phenomenon occurs at the upper surface of the body, the center portion of the rear plate accommodates a part of the bulged upper surface of the body.

4. The refrigerator according to claim 3, wherein the top panel further comprises a hinge cover and the hinge cover is integrally formed with the top cover.

5. The refrigerator according to claim 3, wherein the top panel further comprises a door switch and the front plate defines a door switch hole to attach the door switch on the front plate.

6. The refrigerator according to claim 3, wherein the front plate comprises a display.

7. A refrigerator comprising:

a body defining a storage compartment;

a pair of doors respectively installed at sides of the body and rotatable to open or close the storage compartment, each door comprising a hinge;

a top panel coupled with an upper surface of the body; and a pair of hinge covers integrally formed with respective sides of the top panel and protruding beyond a front surface of the body to cover the hinges, respectively, wherein the top panel comprises a top cover at an upper portion of the top panel, a front plate having a door switch hole and a display at a front of the top panel, a plurality of side plates respectively at sides of the panel, and a rear plate at a rear of the panel, the front plate and the side plates being provided at ends thereof with stepped portions to cover corresponding surfaces adjacent to a corner of the body, wherein the rear plate of the top panel includes end portions, which extend from the respective side plates and each of which has a lower end supported on the upper surface of the body, and a center portion which extends between the end portions, and wherein a lower end of the center portion of the rear plate is spaced apart from the upper surface of the body, whereby when a bulging phenomenon occurs at the upper surface of the body, the center portion of the rear plate accommodates a part of the bulged upper surface of the body.

* * * * *